United States Patent [19]

Bellis et al.

[11] Patent Number: 4,714,100

[45] Date of Patent: Dec. 22, 1987

[54] METHOD AND APPARATUS FOR CHANGING A MOLD BOX ON A MOLDING MACHINE

[75] Inventors: Kenneth E. Bellis, Rochester; Jackson E. Brown, Mt. Clemens; Pheroze J. Nagarwalla, Rochester Hills, all of Mich.

[73] Assignee: Roberts Corporation, Lansing, Mich.

[21] Appl. No.: 937,579

[22] Filed: Dec. 3, 1986

[51] Int. Cl.[4] ..... B22C 11/04; B22C 17/02; B22C 25/00

[52] U.S. Cl. ..... 164/18; 164/16; 164/159; 164/180; 164/228

[58] Field of Search ..... 164/16, 18, 37, 40, 164/44, 137, 159, 169, 192, 193, 213, 228, 200–202

[56] References Cited

U.S. PATENT DOCUMENTS

| | | | |
|---|---|---|---|
| 3,303,536 | 2/1967 | Pegon | 164/137 |
| 3,528,481 | 9/1970 | Lund | 164/200 X |
| 3,556,195 | 1/1971 | Lund | 164/16 |
| 4,588,014 | 5/1986 | Blower et al. | 164/159 X |

FOREIGN PATENT DOCUMENTS

| | | | |
|---|---|---|---|
| 55-36021 | 3/1980 | Japan | 164/16 |
| 58-53350 | 3/1983 | Japan | 164/180 |
| 1352562 | 5/1974 | United Kingdom | 164/16 |

*Primary Examiner*—Nicholas P. Godici
*Assistant Examiner*—J. Reed Batten, Jr.
*Attorney, Agent, or Firm*—Thomas K. Ziegler; Raymond J. Eifler

[57] ABSTRACT

A machine for making molds and molding cores (126) includes a pair of mold boxes (**42*a*, 42*b*) removably mounted on a frame (60) for rotation between an upright, molding position in which molding material is introduced into the molding cavity of the molding boxes (42*a*, 42*b*) by a carrier (26) and an inverted discharge position in which the mold (126) is removed from the boxes by a mold receiving assembly (76). A pressure head assembly (46) both compresses molding material within the molding cavity and introduces a catalyst gas into the cavity for curing the molding material. A system for removing the spent gas from the molding cavity includes a pair of gas receiving chambers (122*a*, 122*b*) integral with the frame (60) which receives gas through the bottom of the mold boxes (42*a*, 42*b*) and an exhaust assembly (68, 70) which is selectively coupled with exhaust ports (124*a*, 124*b*) in the chambers (122*a*, 122*b*). A mold transfer carriage (84) transfer molds (126) discharged from the mold boxes (42*a*, 42*b*) to either of two lateral positions and can be employed to automatically change mold boxes (42*a*, 42*b*) which are mounted on the frame (60) by quick release connections (62, 64, 134**).

21 Claims, 14 Drawing Figures

METHOD AND APPARATUS FOR CHANGING A MOLD BOX ON A MOLDING MACHINE

The present invention broadly relates to molding machines for producing molds or cores, especially of the type which employ shiftably mounted mold boxes having mold cavities into which molding material is compressed. More particularly, the invention relates to a method and apparatus for automatically changing the mold boxes without the need for human intervention.

One type of molding machine which is commonly employed for making molds and cores from sand or similar material employs a mold box mounted on a rotatable frame. Means are provided for filling the mold box with molding material and for rotating the box between an upright molding position in which a mold is formed, to an inverted discharge position in which the mold may be removed from the mold box. A reciprocable press assembly is employed to compress the molding material in the box when the latter is in its upright molding position. After the mold box has been rotated to its inverted, discharge position, an elevator assembly positioned beneath the frame is raised to engage, support, and then lower the finished mold onto a mold transfer mechanism which then transports the finished mold laterally away from the machine to a position where it can be unloaded. Each mold box which is mounted on the rotatable frame possesses a mold cavity unique to the particular mold to be formed. Consequently, it is necessary to remove and replace the mold boxes when a different type of configuration of mold is to be formed. In some cases, the press plate is uniquely configured for a given mold and must also be replaced along with the mold box. Bolts or similar types of fasteners have been used in the past to secure the mold box and/or press plate to the machine. A molding machine of the type described above is disclosed in detail in U.S. Pat. No. 3,348,606 entitled "Molding Machine Transfer Mechanism" issued Oct. 24, 1967.

Although the molding machine described above is entirely suitable for its intended purpose, it is less than completely satisfactory where high productivity is an important goal. Considerable time and labor must be expanded to change mold boxes and the press plate of such a machine, thus resulting in machine down time and concomitant loss of productivity.

SUMMARY OF THE INVENTION

According to one aspect of this invention, an apparatus is provided for changing one or more mold boxes on a molding machine. The machine is of the type including a rotatable frame, at least one mold box on the frame having a mold cavity for forming a mold and being rotatable with the frame from a molding position in which a mold is formed in the mold cavity to a mold discharge position in which a mold may be removed from the mold box. The machine further includes means for receiving and lowering the mold from the mold box and means for transferring the mold laterally from the receiving means to an unloading position. The apparatus comprises means for releasably mounting the mold box on the frame and means on the mold receiving means for supporting the mold box when the latter is released from the frame so that the mold box can be vertically shifted by the mold receiving means between a lowered position and a raised position in which the mold box can be either mounted to or released from the frame. The mold box is releasably mounted to the frame by a quick release clamping assembly which is operated by a motor. The mold transferring means is employed to transfer the mold box laterally between the mold receiving means and a loading position. The mold transfer means includes a plurality of locating pins thereon for precisely locating the mold box so that it is delivered to a preselected position beneath the frame. The machine includes a press head assembly having a press plate which is removably mounted on the press head by means of a quick release clamping mechanism. The press plate may be clamped to the mold box to facilitate automatic installation and removal of the press plate.

According to another aspect of the invention, a method is provided for installing or changing one or more mold boxes on a molding machine of the type described hereinabove. The method includes the steps of raising the mold receiving means to an elevated position engaging the mold box, releasing the mold box from the frame, supporting the mold box on the mold receiving means, lowering the mold receiving means with the mold box supported thereon and then removing the mold box from the mold receiving means. A mold box is installed on the machine by placing the mold box in a preselected position on the mold transferring means, transferring the mold box laterally to a preselected position beneath the frame using the mold transferring means, raising the mold box from its preselected position beneath the frame to an elevated position adjacent the frame, and mounting the mold box onto the frame while the mold box is supported on the mold receiving means.

Accordingly, one advantage of this invention lies in apparatus for automatically changing one or more mold boxes on a molding machine. Another advantage lies in apparatus as mentioned above which minimizes the down time of the machine associated with mold changeover, and therefore maximizes productivity.

Another advantage of this invention is to provide apparatus as described above which minimizes the need for human intervention and possible error during mold changeover.

Another advantage of this invention lies in a method of changing mold boxes on a molding machine which is especially simple, rapid and employs the mechanisms normally used to remove or transfer a mold from the mold box.

BRIEF DESCRIPTION OF THE DRAWINGS

Referring now to the drawings, FIGS. 1 and 2 illustrate a machine generally indicated by the numeral 20 for forming molds. The molds may be an end product, or may be "cores" which are employed in subsequent molding and casting processes. The machine 20 includes a supporting frame comprising upright frame members 25 joined together by horizontal frame members 27. A mold box frame 60 is mounted for rotation about an essentially horizontal axis by means of trunnions 21 which in turn are secured to the horizontal frame members 27. The frame 60 is rotated by means of a conventional rotary actuator 66 which is mounted on a bracket 93.

Figure 1:
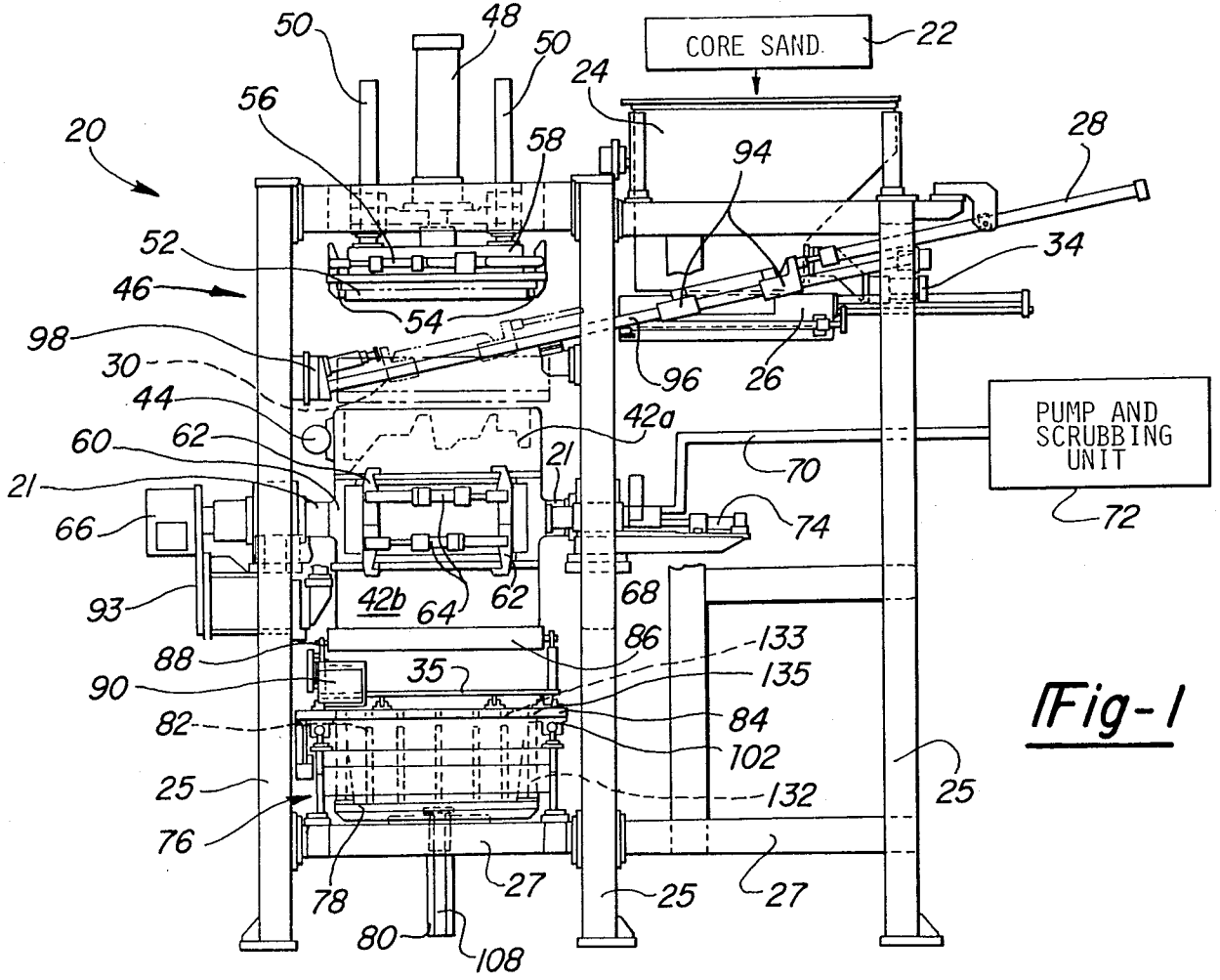
FIG. 1 is a front elevational view of a machine for making molds which forms the preferred embodiment of the present invention, the operating position of the sand carrier being indicated in the phantom.

Mounted on opposite sides of the frame 60 are a pair of mold boxes 42*a*, 42*b*, each having a mold cavity configured to form the desired mold or core. The mold boxes 42*a*, 42*b* are releasably mounted on the frame 60 by means of a quick release mechanism comprising clamps 62 which are individually controlled by hydraulic cylinders 64. A conventional vibrator 44 may be mounted on each of the mold boxes 42*a*, 42*b* for the purpose of vibrating the corresponding mold box to encourage settling and compacting of molding material therein.

As will be discussed later, the frame 60 is in the form of a housing having exhaust chambers therein which may be connected with an exhaust line 70 by means of an exhaust coupling 68. The exhaust coupling 68 is positioned laterally of the frame 60 and is reciprocated horizontally by means of a hydraulic cylinder 74, between a standby position in which the frame 60 is free to rotate, and an operating position in which the exhaust coupling 68 is connected with the frame 60 when the latter is stationary. The exhaust line 70 is connected with a pump and scrubbing unit 72 of conventional design which draws spent exhaust gas from the frame 60.

Figure 2:
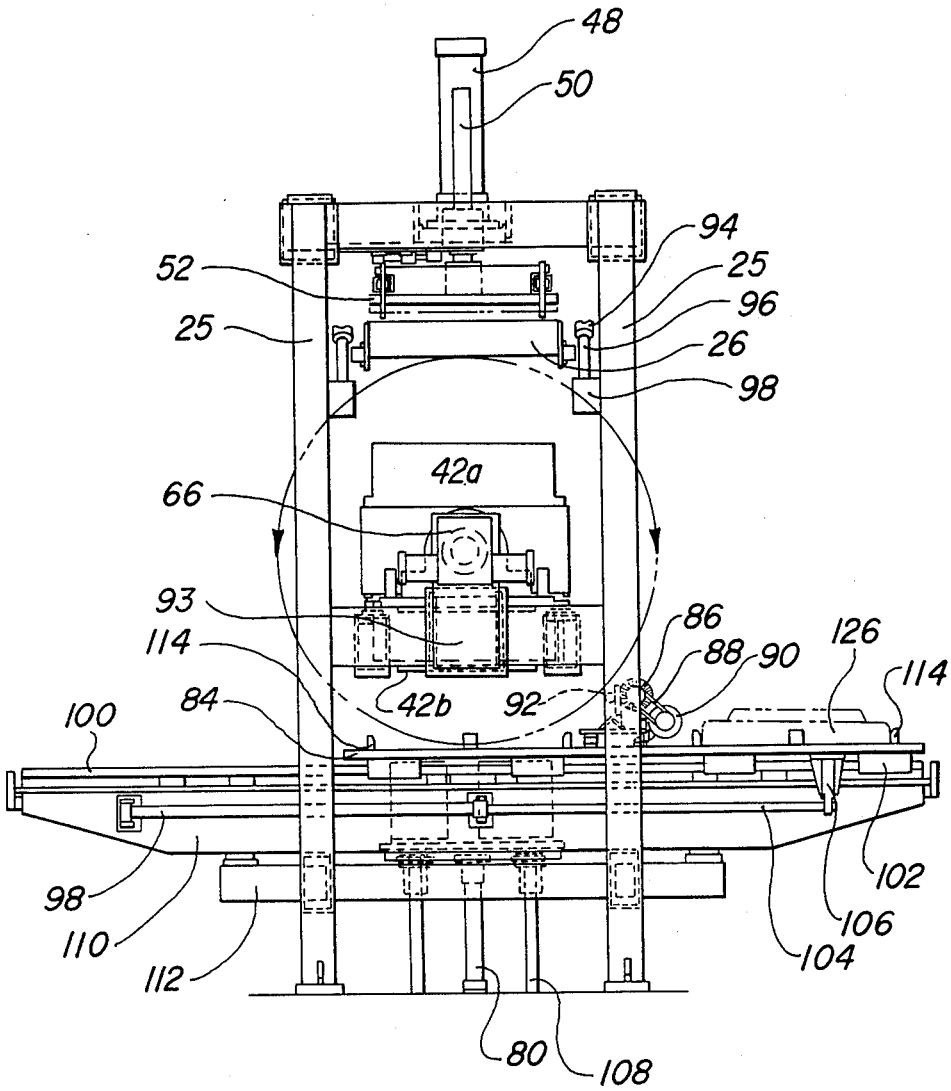
FIG. 2 is a side elevational view of the machine shown in FIG. 1.

As will be discussed below, the tops of the mold boxes 42*a*, 42*b* are open so as to allow molding material to be introduced therein and to permit a finished mold or core to be removed therefrom. The mold boxes 42*a*, 42*b* are each rotatable along with the frame 60 from an upright, molding position to an inverted, discharge position. As shown in FIGS. 1 and 2, the mold box 42*a* is in the molding position thereof and the mold box 42*b* is in the discharge position thereof.

Mounted on the frame members 25, 27 is a hopper 24 into which molding material such as sand is introduced from a source 22 thereof. The sand or other molding material includes a binding agent of a conventional type which can be activated by a catalyst gas to bind the sand and thereby form a mold or core. A hydraulic cylinder 34 controls a later discussed gate to allow sand to flow from the bottom of the hopper 24 into a sand carrier 26. The sand carrier 26 is mounted for inclined lateral movement between a standby position as shown in FIG. 1 in which sand may be introduced therein from the hopper 24 to an operating position immediately above the mold box 42*a*. The sand carrier 26 is mounted on a pair of inclined guide rods 96 secured to brackets 98, by means of bushings 94. The sand carrier 26 is driven between its operating and standby positions by a hydraulic cylinder 28.

Mounted immediately above the rotating frame 60 is a pressure head assembly generally indicated by the numeral 46. The pressure head assembly 46 includes a manifold head 58 driven for vertical reciprocation by a hydraulic cylinder 48 and guided in its vertical movement by guide rods 50. A gassing/press plate 52 is removably mounted on the bottom face of the manifold head 58 by means of a quick release mechanism comprising clamps 54 which are controlled by hydraulic cylinders 56.

Disposed beneath the rotating frame 60 is a horizontally extending support table 110 which extends laterally beyond the upright frame members 25, as best seen in FIG. 2. The support table 110 is in turn mounted on a cross frame 112 which is secured to the upright frame members 25. A pair of spaced apart guide rods 100 are secured to the upper face of the support table 110. A horizontal mold transfer carriage 84 which may comprise a plate is mounted on the guide rods 100 by means of bushing assemblies 102 so as to move laterally beneath the rotating frame 60. The transfer carriage 84 is driven on the guide rods 100 by means of a hydraulic cylinder 98 having an output piston rod 104 connected to the carriage 84 by a bracket 106. Mounted on the upper face of the transfer carriage 84 are two sets of locating pins 114 whose purpose will be described below. The transfer carriage 84 has a length sufficient to define two sections which respectively accommodate two molds or cores: one mold 126 disposed on one section of the carriage 84 immediately beneath the rotating frame 60, and the other mold 126 disposed laterally outboard on the second section of the carriage 84 so that access may be had to the outboard mold while a subsequently formed mold is being deposited on the transfer carriage 84.

Mounted on the upper surface of the transfer carriage 84, between the two sets of locating pins 114 is a support bracket 35. A cylindrical brush 86 is mounted for rotation on the bracket 35 and is driven by a conventional motor 90 via a belt 88. Also mounted on the bracket 35 is an air distribution pipe 92 which is connected with a suitable source of pressurized air (not shown) and includes upwardly facing apertures (not shown) therein so that compressed air flows upwardly from the pipe 92, along essentially its entire length.

Positioned below the transfer carriage 84 is a mold receiving and transfer assembly generally indicated by the numeral 76. The mold receiving and transfer assembly 76 includes a support 78 driven for vertical reciprocation by a hydraulic cylinder 80 and guided in its vertical movement by rods 108. Mounted on the upper face of the support 78 are a plurality of vertically extending essentially U-shaped mold support fingers 82. Also mounted on the upper face of the support 78 are a pair of spaced apart mold box support arms 132 which are adapted to engage and support each of the mold boxes 42a, 42b during changeover of such mold boxes, as will be discussed later in more detail. The transfer carriage 84 includes a plurality of elongate openings 133 therein which register with the fingers 82 and which register with support arms 132 so that the fingers 82 and support arms 132 may pass upwardly through the carriage 84.

The control system for operating the various parts of the machine 20 is of a conventional design and may be of the general type, for example, disclosed in U.S. Pat. No. 3,348,606, consequently, the details of such system need not be discussed herein.

Figures 3, 4:
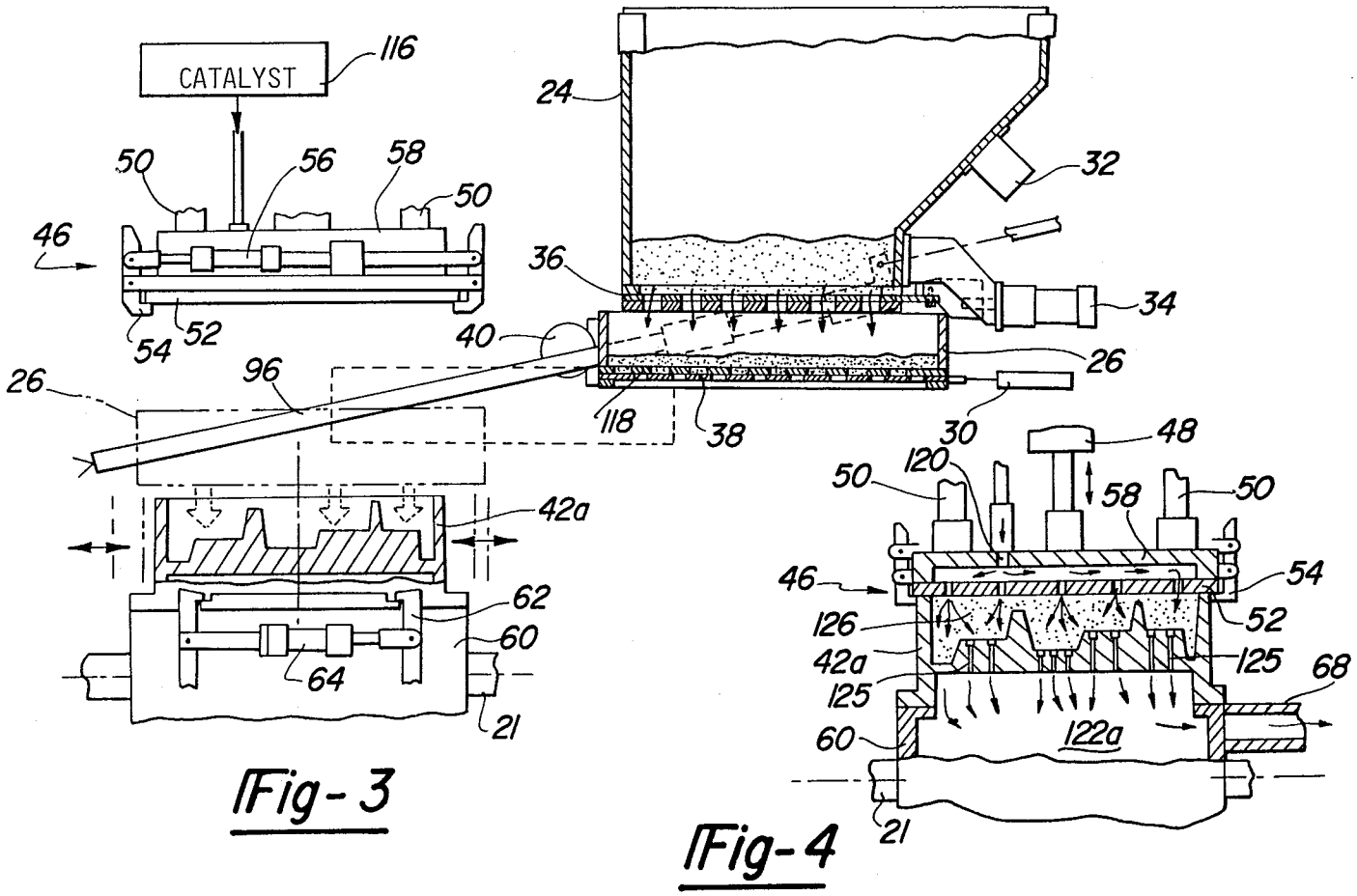
FIG. 3 is a fragmentary, sectional view showing the sand carrier in operative relationship to the press head assembly and mold box.
FIG. 4 is a fragmentary, sectional view depicting the press head assembly in an operating position and showing the flow path of the activating gas.

FIG. 3 illustrates the hopper 24 and sand carrier 26 in more detail. Sand introduced into the top of the hopper 24 is drawn to the bottom thereof by the influence of gravity, aided by a suitable vibrator 32 mounted on the wall of the hopper 24. The bottom of the hopper 24 is perforate and includes a hopper gate 36 controlled by the hydraulic cylinder 34 to allow sand in the hopper 24 to flow into the generally rectangular sand carrier 26. A vibrator 40 is mounted on a sidewall of the sand carrier 26 to aid in discharging sand from the carrier 26 into the mold cavity of a mold box such as mold box 42a disposed in the molding position thereof. The sand carrier 26 includes a peforate bottom wall 11B beneath which there is provided a sand carrier gate plate 38 which is controlled by hydraulic cylinder 30. The manifold head 58 is coupled with a source of catalyst gas 116.

FIG. 4 illustrates the operation of the pressure head assembly 46 during the pressing and gassing operation. The catalyst gas from the source 116 flows into the hollow interior of the manifold head 58 and then outwardly through apertures in the plate 52 into the mold cavity of the mold box 42a. The bottom of each of the mold boxes 42a, 42b includes a plurality of passageways 125 therein which place the mold cavity in gas flow communication with exhaust chambers in the frame 60, one of such chambers being designated by the numeral 122a in FIG. 4.

Figure 5:
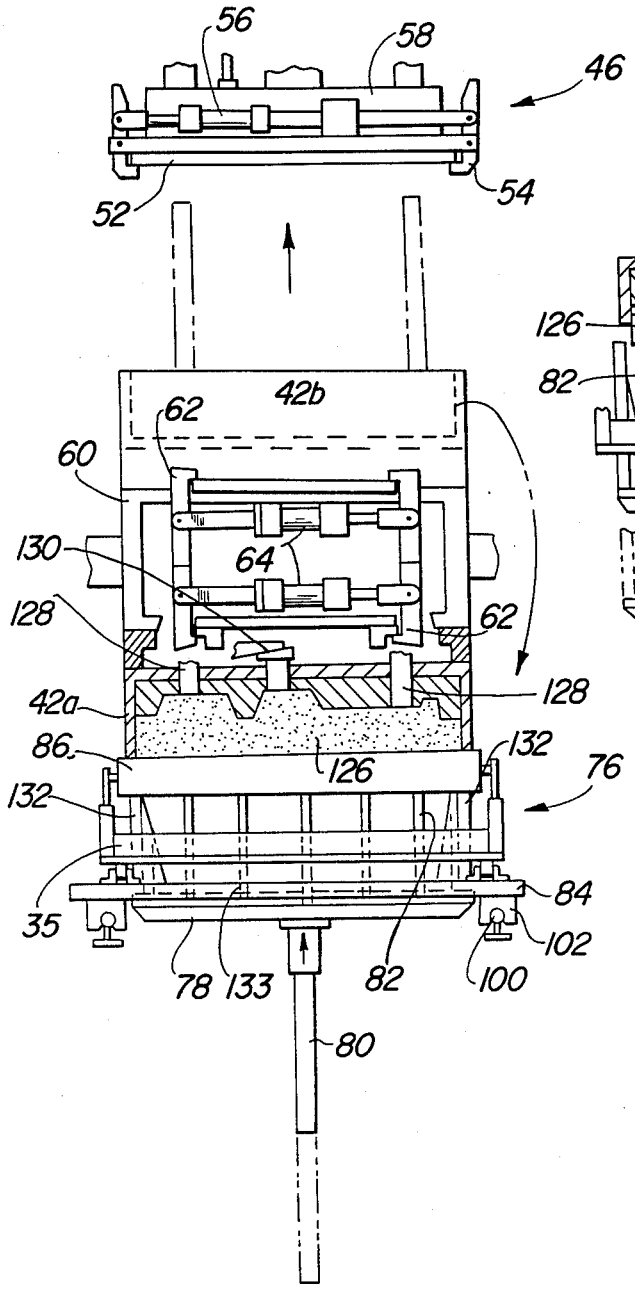
FIG. 5 is a front view, partially in section, of a portion of the machine and depicting a mold being discharged from a mold box.

FIG. 5 depicts the frame 60 having been rotated 180 degrees so that the mold box 42a is in its inverted, discharge position. FIG. 5 also depicts an ejection mechanism for ejecting the mold 126 from the box 42a. Various types of ejector assemblies may be satisfactorily employed, one such ejector system being shown in U.S. Pat. No. 3,348,606 mentioned hereinabove. Thus, it is not necessary to disclose the details of such an ejector assembly herein. However generally, such an assembly will include a plurality of ejector pins 128 which are actuated by a cam assembly 130 for example, and which extend through the bottom of the molding box 42a so as to engage the mold 126 and force the latter downward while the mold 126 is supported by the mold supporting fingers 82.

Figure 6:
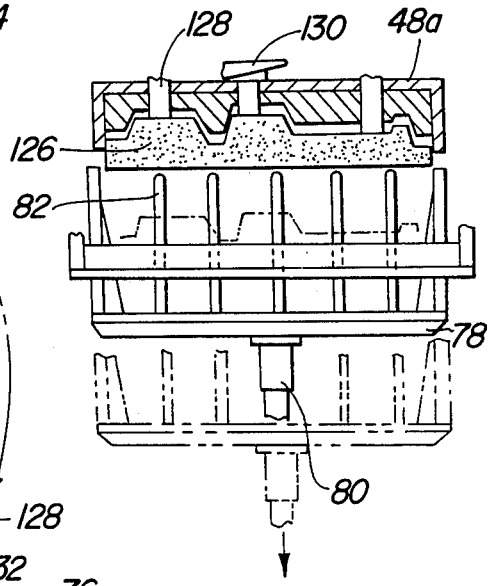
FIG. 6 is a view similar to FIG. 5 but at a later interval during the discharge of the mold.

As shown in FIG. 6, the downward movement of the support 78 and fingers 82 is synchronized with the displacement of the ejector pins 128 so that the mold 126 has ejection pressure evenly supplied thereto while being supported at all times by the fingers 82.

Figure 7:
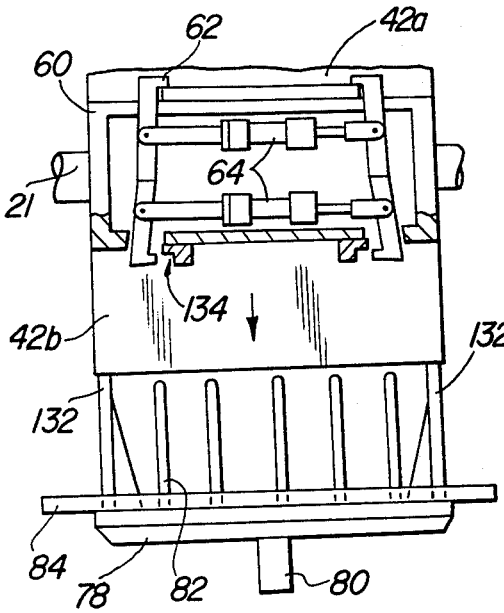
FIG. 7 is a fragmentary, front elevational view of a portion of the machine depicting an initial step in removing a mold box from the rotating frame.
Figure 8:
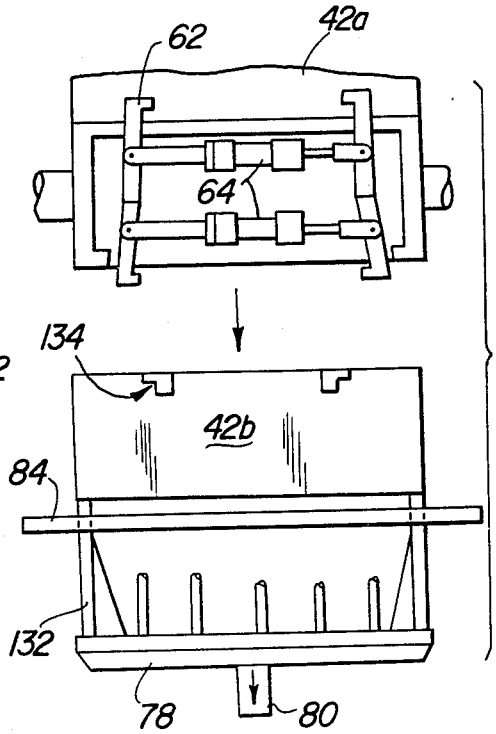
FIG. 8 is a view similar to FIG. 7 but depicting a mold box being lowered onto the transfer carriage.

FIGS. 7 and 8 illustrate the manner in which the mold boxes 42a, 42b can be removed from the rotating frame 60. Each of the mold boxes 42a, 42b is provided with a locking member 134 which matably engages with the clamps 62. The clamps 62 are disengaged and shifted free of the locking member 134 by means of the hydraulic cylinder 64. Prior to releasing a mold box 42b while the latter is in the discharge position thereof, the support 78 is elevated until the support arms 132 contact the bottom of the mold box 42b. FIG. 8 depicts the support 78 as having been lowered so as to lower the mold box 42b onto the transfer carriage 84.

Figure 9:
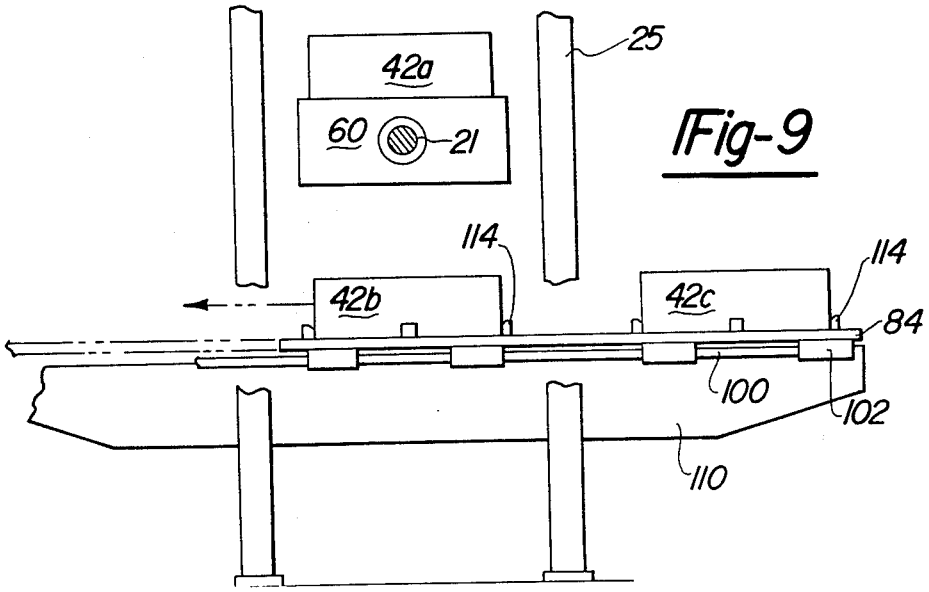
FIG. 9 is an essentially diagrammatic frontal view of the machine during changing of the mold boxes.

FIG. 9 depicts the mold box 42b as having been lowered onto the transfer carriage 84. The mold box 42b is received within the locating pins 114. A third mold box 42c is positioned on one end of the transfer plate 84 in a preselected position determined by the locating pins 114.

Figure 11:
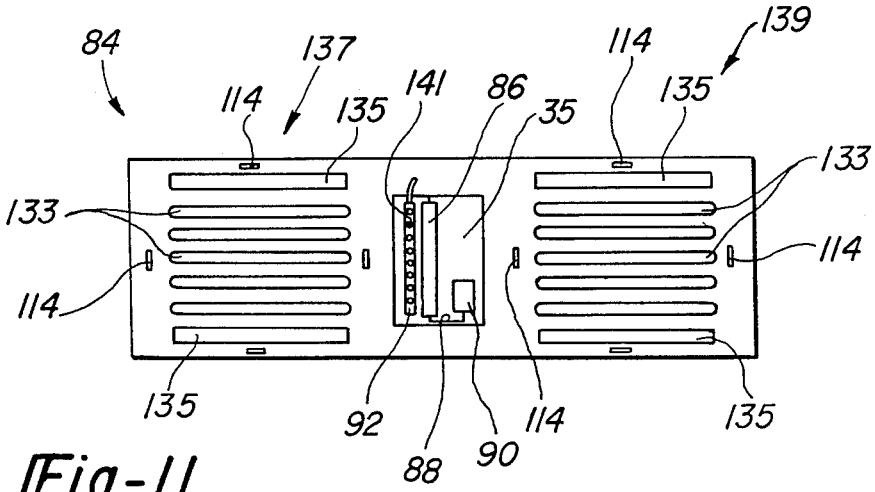
FIG. 11 is a plan view of the mold transfer carriage.

FIG. 11 illustrates the details of the mold transfer carriage 84. The carriage includes first and second longitudinally spaced sections 137 and 139 respectively upon each of which a mold (not shown) or a mold box (not shown) can be supported. Each section 137, 139 of the carriage 84 includes a first set of longitudinally extending elongate openings 133 therein through which the mold support fingers 82 (FIG. 1) may extend, as well as a second set of outboard, longitudinally extending openings 135 through which the mold support arms 132 (FIG. 1) may extend. The brush 86 and air pipe 92 extend parallel to each other and transverse to the path of travel of the carriage 84. The air pipe 92 is shown as having spaced apart, upwardly facing apertures 141 therein through which pressurized air may pass.

Figure 10:
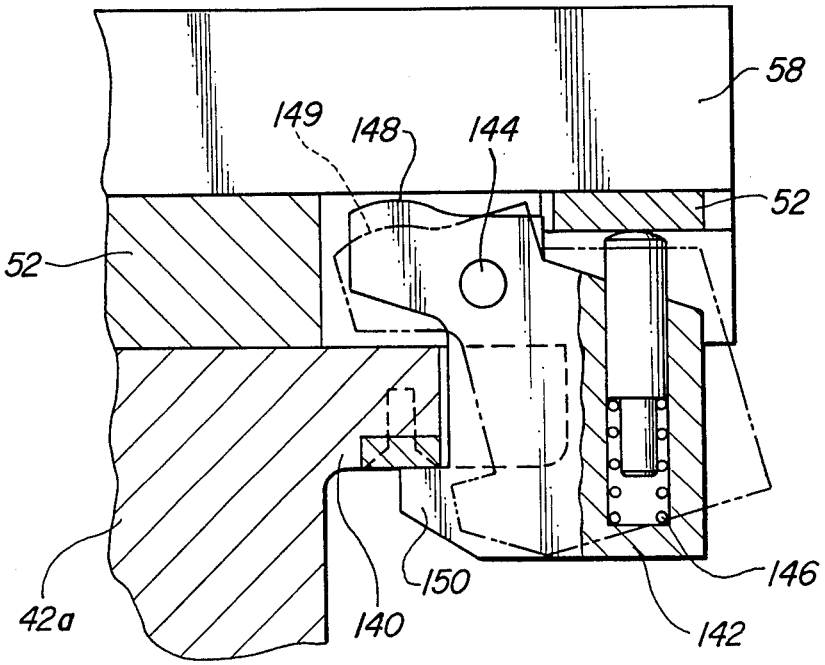
FIG. 10 is an enlarged, fragmentary view, taken partially in section and showing a mechanism for automatically clamping the gassing/press plate on a mold box.

FIG. 10 depicts the details of a mechanism for releasably clamping the gassing press/plate 52 to the top of one of the core boxes, such as core box 42a. A plurality of clamping members 142 are pivotally mounted by means of corresponding pivot pins 144 around the periphery of the gassing/press plate 52. Each of the clamping members 142 includes a hook portion 150 which is adapted to engage the bottom side of a peripheral shoulder 140 of the mold box 42a. The clamping members 142 also include a camming surface 148 which is adapted to be engaged by a downwardly extending cam button 149 on the bottom of the gassing/press plate 52. A spring assembly 146 is provided for normally biasing the clamping member 142 to pivot clockwise as viewed in FIG. 10.

Figure 12:
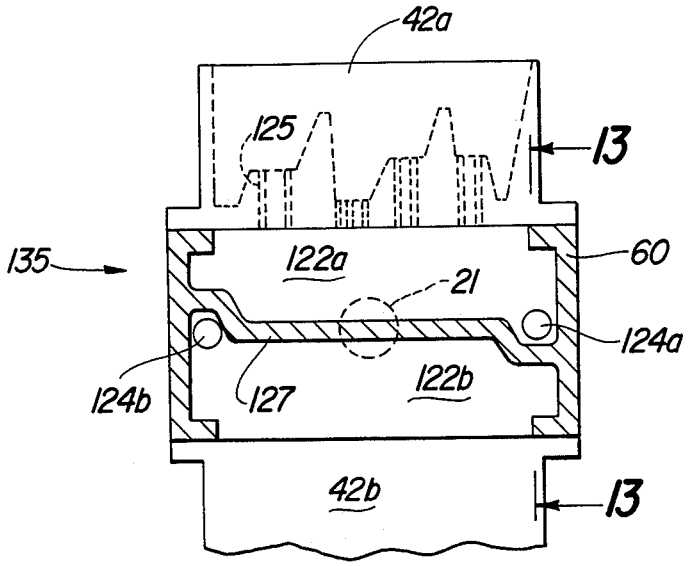
FIG. 12 is a sectional view of the frame depicting the exhaust chambers in operative relationship to the corresponding mold boxes.
Figure 13:
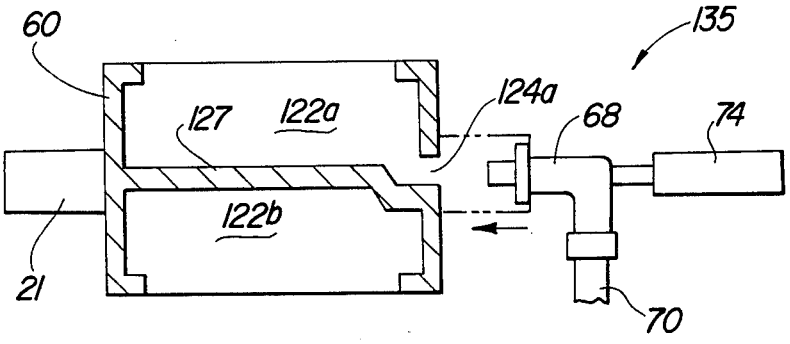
FIG. 13 is a sectional view taken along the line 13—13 in FIG. 12.

FIGS. 12 and 13 depict the details of a means 135 for removing spent gas from the mold cavities of the mold boxes 42a, 42b. The gas removing means 135 includes a pair of exhaust chambers 122a, 122b defined in the housing-like rotating frame 60. The exhaust chambers 122a, 122b are separated by a partition 127. The bottom faces of the mold boxes 42a, 42b form one wall of the corresponding exhaust chambers 122a, 122b. The mold cavities of the mold boxes 42a, 42b communicate with the corresponding chambers 122a, 122b by means of passageways 125 in the bottom of the corresponding mold boxes 42a, 42b. The frame 60 includes a pair of lateral exhaust ports 124a, 124b which communicate with the associated chambers 122a, 122b. These exhaust ports 124a, 124b are equally radially spaced from the axis of the trunnion 21 so that they trace the same circular path upon rotation of the frame 60. The gas exhaust coupling 68 is positioned on one side of the frame 60 and at a position radially spaced from the axis of the trunnion 21 so as to be aligned with the rotational path of the ports 124a, 124b associated with the mold boxes 42a, 42b which are disposed at the upright molding position thereof. The hydraulic cylinder 74 shifts the exhaust coupling 68 from a standby position to an operating position in which the exhaust line 70 is connected with the corresponding exhaust chamber 122a, 122b.

Figure 14:
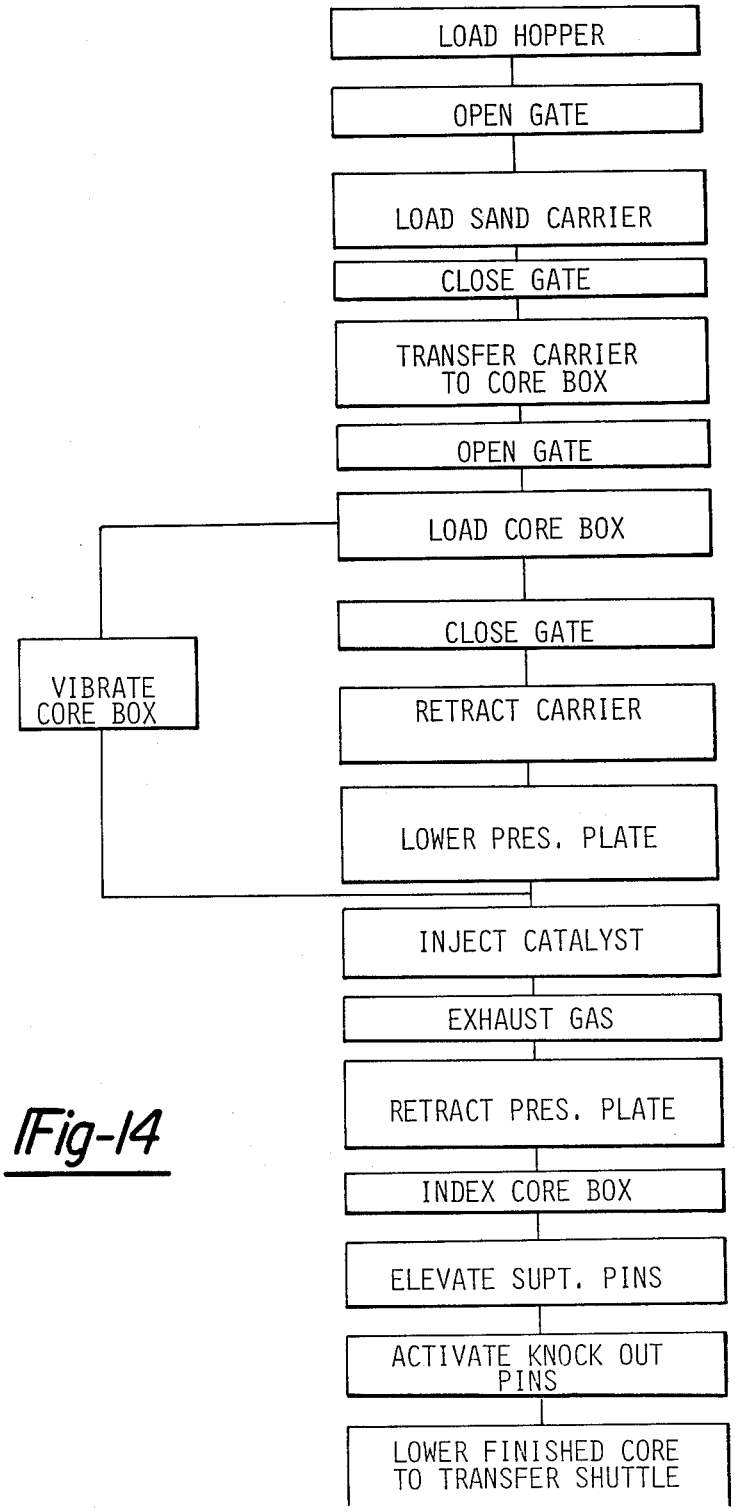
FIG. 14 is a flow chart of the steps in the operation of the machine.

FIG. 14 depicts the steps involved in a typical molding operation which will be discussed below in connection with a description of the operation of the machine.

OPERATION

Referring to FIGS. 1, 2 and 3, sand is first loaded into the hopper 24 following which the hopper gate 36 is opened by the cylinder 34 to place a charge of sand in the carrier 26. The hopper gate 36 is then closed. The cylinder 28 is actuated to move the carrier 26 from its normal, standby position to an operating position disposed immediately above the mold box 42*a*. With the sand carrier positioned immediately above the mold box 42*a*, cylinder 30 is actuated to open the carrier plate 38 and allow sand within the carrier to fall into the open mold cavity of the mold box 42*a*. The vibrator 40 may be energized to increase the flow of sand from the carrier 26 into the mold box 42*a*. While the mold box 42*a* is being loaded with sand from the carrier 26, the vibrator 44 may be energized to vibrate the mold box 42*a* and thereby aid in the settling and compacting of the sand therewithin. Typically, the entire mold cavity of the mold box 42*a* is filled and preferably, the deposited sand may extend slightly above the top of the mold box 42*a*. The carrier plate gate 38 is then closed and the carrier 26 is retracted from its operating position to its standby position.

The pressure head assembly 46 is then lowered as shown in FIG. 4 until the gassing/press plate 52 engages the sand extending above the top of the mold box 42*a* and forces the sand downwardly thereby compacting the sand to some extent within the mold cavity. With the sand within the mold cavity having been compacted, catalyst gas from the source 116 then flows into the manifold head 58 and out through the openings in the gassing/press plate 52 and into the mold cavity. As discussed above, the catalyst gas functions to activate the binder which has been mixed with the sand thereby resulting in the sand becoming bound together to form a mold or core.

Referring to FIGS. 1, 12 and 13, the cylinder 74 is activated to shift the exhaust coupling 68 into the exhaust port 124*a*. The pump and scrubbing unit 72 is activated in order to create a partial vacuum in the exhaust chamber 122*a*. This partial vacuum functions to draw spent gas in the mold cavity downwardly through the passageways 125 into the exhaust chamber 122*a* and then through the port 124*a* into the exhaust line 70. The spent gas is then cleansed by a conventional scrubbing unit 72.

After a sufficient quantity of gas has been introduced into the mold cavity, the pressure head assembly 46 is retracted to its elevated position and the frame 60 is rotated 180° so that the mold box 42*a* having the finished mold 126 therein is positioned in an inverted discharge position and the empty mold box 42*b* is positioned in the upright, molding position, as shown in FIG. 5. Referring now to FIG. 5, the support 78 is moved upwardly until the fingers 82 engage or are in close proximity to the mold 126. The ejector pins 128 are then actuated to force the mold 126 downwardly. Simultaneous with the actuation of the ejector pins 128, the support 78 is moved downwardly in synchronism with the downward movement of the ejector pins 128 so that the mold 126 is supported at all times while it is being ejected from the mold cavity. The support 78 continues its downward movement until the mold 126 comes to rest on the transfer carriage 84. With the mold 126 resting on one end of the transfer carriage 84, the cylinder 98 is actuated to shift the transfer carriage 84 in one direction along the guide rods 100. It should be noted here that since the transfer carriage 84 is sufficiently long to accommodate two molds 126, the ejected mold may be transferred either to the left or to the right side of the machine 20. FIG. 2 depicts the position of the transfer carriage 84 after it has transferred a mold 126 to the right side of the machine 20. The mold 126 is then removed either manually or with suitable automatic handling equipment. Note also, as shown in FIG. 2 that the left end of the transfer carriage 84 is readied beneath the rotating frame 60 in preparation for receiving the next mold 126. Thus, it is not necessary to delay forming the next mold and ejecting it onto the transfer carriage 84 until the previous mold has been removed from the transfer carriage 84.

Referring particularly to FIGS. 1 and 2, it is highly desirable to clean the outer face of a mold box 42*a*, 42*b* after a mold 126 has been formed therein and discharged therefrom. This cleaning operation is performed by the brush 86 and air pipe 92. After a mold 126 has been discharged from the inverted mold box 42*b*, the motor 90 is energized thereby turning the brush 86. As the transfer carriage 84 moves along the guide rods 100, the rotating brush 86 comes in contact with the brushes or sweeps away material on the face of the core box 42*b*. At the same time, pressurized air exiting from the air pipe 92 blows into the mold cavity thereby assisting in removing residual sand therefrom. During the interval in which a mold 126 is being discharged from an inverted mold box 42*a* the molding process is repeated for the molding box 42*b* which is in the upright, molding position. It may thus be appreciated that the machine 20 maximizes productivity.

In addition to automatically forming and removing molds 126, the machine is also capable of automatically changing tooling consisting of the gassing/press plate 52 and the mold boxes 42*a*, 42*b*. This mode of operation is depicted in FIGS. 7, 8 and 9. When it is desired to change or replace one of the mold boxes 42*a*, 42*b* such box is first rotated to its inverted, discharge position, as shown in FIG. 7. The cylinders 64 are then activated to release the clamps 62 from the locking members 134. Prior to unlocking the clamps 62, the support 78 is moved upwardly until the support arms 132 contact and support the core box 42*b*. After clamps 62 have been unlocked, the support 78 is moved downwardly until the core box 42*b* engages and comes to rest on the top of the transfer carriage 84. As shown in FIG. 9, with the core box 42*b* positioned on one end of the transfer carriage 84, the latter may be moved to the left to position a new mold box 42*c* in registered relationship immediately beneath the rotating frame 60. The support 78 is again elevated until the support arms 132 engage the bottom face of the new mold box 42*c*. Continued upward movement of the support 78 moves the new mold box 42*c* into position in engagement with the rotating frame 60. The corresponding hydraulic cylinder 64 is then activated to move the clamps 62 into locking relationship with the locking members 134, thereby securing the new mold box 42*c* in place. With the new mold box 42*c* in place, the frame 60 is rotated 180° and the mold box 42*a* is removed in a manner similar to that described above with respect to mold box 42*b*. After at least one of the mold boxes 42*a*, 42*b* have been removed from the transfer carriage 84, a fourth mold box (not shown) is placed on the transfer carriage 84 in a preselected position determined by the locater pins 114. The transfer carriage 84 is then shifted until the fourth mold box is positioned beneath the frame 60. The fourth mold box is mounted on the frame 60 in the manner described above with respect to mold box 42c.

Referring now to FIGS. 1, 2 and 10, in some cases it may be desirable or necessary to replace the gassing/-press plate 52 with another of such plates that may be differently configured. This can be automatically performed by the machine 20 of the present invention by lowering the press head assembly 46 until the plate 52 engages the top of one of the mold boxes 42a and the buttons 149 engage the cam surface 148 to open the clamps 142. The cylinder 56 is then activated to release the clamps 54 which hold the plate 52 on the manifold head 58. Thereafter, when the press head assembly 46 moves upwardly, the springs 146 close the clamps 142 to lock the gassing/press plate 52 onto the mold box 42a. Thus, when the mold box 42a is rotated to its discharge position in preparation for removing it from the frame 60, the plate 52 is attached thereto and the plate 52 and mold box 42a are removed as a single unit from the frame 60.

We claim:

1. Apparatus for changing a mold box (42a) on a molding machine (20), said machine (20) being of the type including a rotatable frame (60), at least one mold box (42a) on said frame (60) having a mold cavity therein for forming a mold (126) and being rotatable with said frame (60) from a molding position in which a mold (126) is formed in said mold cavity to a mold discharge position in which a mold (126) may be removed from said one mold box (42a), means (76) for receiving and lowering said mold (126) from said one mold box (42a) when said one mold box is in said discharge position thereof, and means (84) for transferring said mold (126) laterally from said receiving means (76) to an unloading position, comprising:

means (62, 64, 134) for releasably mounting said one mold box (42a) on said frame (60); and, means (132) on said receiving means (76) for supporting said one mold box (42a) on said receiving means when said one box (42a) is released from said frame (60), whereby said one mold box (42a) may be vertically shifted by said mold receiving means (76) between a lowered position and a raised position in which said one mold box (42a) may be mounted or released from said frame (60).

2. The apparatus of claim 1, wherein said means (62, 64, 134) for releasably mounting said one mold box (42a) includes a quick release clamping assembly (62, 134) and a motor (64) responsive to a control signal for operating said clamping assembly (62, 134).

3. The apparatus of claim 2, wherein said quick release clamping assembly (62, 134) includes a plurality of shiftable clamps (62) mounted on said frame (60) and a plurality of locking members (134) on said one mold box (42a) respectively cooperating with said shiftable clamps (62).

4. The apparatus of claim 1, wherein said supporting means (132) includes a pair of vertically extending, spaced apart support arms (132).

5. The apparatus of claim 1, including means (114) on said mold transferring means (84) for positioning said one mold box (42a) on said mold transferring means (84) in registered relationship to said frame (60) such that said one mold box (42a) is delivered by said mold transferring means (84) to a preselected position beneath said one mold box (42a).

6. The apparatus of claim 5, wherein said mold transferring means (84) includes a carriage (84) adapted to support said one mold box (42a) thereon and said positioning means (114) includes a plurality of locating pins (114) mounted on said carriage (84) for locating said one mold box (42a) on said carriage (84).

7. The apparatus of claim 1, wherein said mold transferring means (84) includes a carriage (84) having a first and second sections for respectively supporting said one mold box (42a) and another mold box (42c) thereon.

8. The apparatus of claim 1, wherein said machine (20) further includes a reciprocable press head (48) having a press plate (52) adapted to press molding material into said mold cavity, and said apparatus includes a quick release connection (54, 56) releasably mounting said press plate (52) on said press head (46).

9. The apparatus of claim 8, wherein said apparatus includes means (140, 142) for releasably mounting said press plate (52) on said one mold box (42a) to allow the combination of said press plate (52) and said one mold box (42a) to be installed or removed from said machine (20) as an assembled unit.

10. The apparatus of claim 9, wherein said releasable mounting means (140, 142) includes a shiftable clamp (142) and a locking member (140) cooperating with said clamp (142).

11. The apparatus of claim 10, wherein said releasable mounting means (140, 142) includes means (146) for normally biasing said clamp (142) to lock with said locking member (140) and thereby clamp said press plate (52) on said one mold box (42a) and a cam mechanism (148, 149) for releasing said clamp (142) from said locking member (140).

12. The apparatus of claim 11, wherein said cam mechanism (148, 149) includes a cam surface (148) on said clamp (142) and a cam element (149) on said press head (46) aligned to engage said cam surface (148).

13. A method for changing a mold box (42) on a molding machine (20), said molding machine (20) being of the type including a rotatable frame (60), at least one mold box (42a) on said frame having a mold cavity therein for forming a mold (126) and being rotatable with said frame (60) from a molding position in which a mold (126) is formed in said mold cavity to a mold discharge position in which a mold may be removed from said one mold box (42a), means (76) for receiving and lowering said mold (126) from said one mold box (42a) when said one mold box (42a) is in said discharge position thereof, means (84) for transferring said mold (126) laterally away from said receiving means (76) to an unloading position, and a reciprocable press head (46) including a press plate (52) for compressing molding material within said mold cavity, comprising the steps of:

(A) raising said mold receiving means (76) to an elevated position engaging said one mold box (42a);

(B) releasing said one mold box (42a) from said frame (60);

(C) supporting said one mold box (42a) on said mold receiving means (76);

(D) lowering said mold receiving means (76) with said one mold box (42a) supported thereon; and (E) removing said one mold box (42a) from said mold receiving means (76).

14. The method of claim 13, including the steps of:

(F) releasing said press plate (52) from said press head (46); and (G) clamping said press plate (52) onto said one mold box (42a) whereby said one mold box and said press plate (52) are removed from said machine as a single assembly.

15. The method of claim 14, wherein step (G) is performed by shifting said press head such that said press plate (52) is brought into engagement with said one mold box (42*a*).

16. The method of claim 13, wherein step (E) is performed by placing said one mold box (42*a*) on said mold transferring means (84) and moving said one mold box (42*a*) laterally away from said mold receiving means (76) using said mold transferring means (84).

17. The method of claim 13, including the steps of;

(F) placing a second mold box (42*c*) in a preselected position on said mold transferring means (84);

(G) moving said second mold box (42*c*) laterally to said mold receiving means (76) using said mold transferring means (84);

(H) raising said second mold box (42*c*) using said mold receiving means (76) to a position adjacent said frame (60); and (I) clamping said second mold box (42*c*) onto said frame.

18. A method for installing a mold box (42) on a molding machine (20), said molding machine (20) being of the type including a rotatable frame (60) adapted to have at least one mold box (42*a*) installed thereon, said mold box (42*a*) having a mold cavity therein for forming a mold (126) and being rotatable with said frame (60) from a molding position in which a mold (126) is formed in said mold cavity to a mold discharge position in which a mold may be removed from said mold box (42*a*), means (76) for receiving and lowering said mold (126) from said mold box (42*a*) when said mold box (42*a*) is in said discharge position thereof, means (84) for transferring said mold (126) laterally away from said receiving means (76) to an unloading position, and a reciprocable press head (46) including a press plate (52) for compressing molding material within said mold cavity, comprising the steps of:

(A) placing said mold box (42*a*) in a preselected position on said mold transferring means (84);

(B) transferring said mold box (42*a*) laterally to a preselected position beneath said frame (60) using said mold transferring means (84);

(C) raising said mold box (42*a*) from said preselected position beneath said frame (60) to an elevated position adjacent said frame (60), said raising being performed using said mold receiving means (76); and (D) mounting said mold box (42*a*) onto said frame while said mold box (42*a*) is supported on said mold receiving means (76).

19. The method of claim 18, including the step of releasably clamping said press plate (52) onto said mold box (42*a*).

20. The method of claim 19, including the steps of bringing said press head (46) into engagement with the combination of said mold box (42*a*) and said press plate (52), releasing said press plate from said mold box (42*a*) and clamping said press plate (52) onto said press head (46).

21. The method of claim 19, wherein said releasable clamping step is performed before step (B) is completed, whereby the mold box (42*a*) and press plate (52) are mounted on said mold box (42*a*) in step (D) as a single assembly.

* * * * *